United States Patent [19]

Chen et al.

[11] Patent Number: 4,953,710

[45] Date of Patent: Sep. 4, 1990

[54] AUTOMATED APPARATUS FOR INSPECTING COLUMNAR BODIES BY EDDY CURRENT METHOD

[75] Inventors: Chung-Mei Chen; Jenn Fu Yang; Weng-Jay Lee; Tsai-Sheng Lin; Yung-Hsing Tsay, all of Kaohsiung, Taiwan

[73] Assignee: China Steel Corporation, Taiwan

[21] Appl. No.: 287,022

[22] Filed: Dec. 21, 1988

[51] Int. Cl.[5] ..... B07C 5/00; B07C 5/344; B07C 5/38

[52] U.S. Cl. ..... 209/518; 209/555; 209/570; 209/626; 209/933

[58] Field of Search ..... 209/517, 518, 539, 555–558, 209/567, 570, 571, 625, 626, 925, 933

[56] References Cited

U.S. PATENT DOCUMENTS

| | | | |
|---|---|---|---|
| 3,263,809 | 8/1966 | Mandula, Jr. et al. | 209/518 |
| 4,155,455 | 5/1979 | Spierer et al. | 209/558 |
| 4,402,412 | 9/1983 | Wood | 209/571 X |
| 4,549,662 | 10/1985 | Schoenig, Jr. et al. | 209/539 |

FOREIGN PATENT DOCUMENTS

| | | | |
|---|---|---|---|
| 0217152 | 1/1985 | Fed. Rep. of Germany | 209/518 |
| 0448899 | 4/1975 | U.S.S.R. | 209/625 |
| 0608571 | 5/1978 | U.S.S.R. | 209/518 |
| 1117088 | 10/1984 | U.S.S.R. | 209/556 |

OTHER PUBLICATIONS

"*Eddy Currents Sort Steel Bars*", authored by T. W. Judd, Control Engineering, Nov. 1964.

*Primary Examiner*—Johnny D. Cherry
*Assistant Examiner*—Edward M. Wacyra

[57] ABSTRACT

An automated apparatus for inspecting columnar bodies by an eddy current method includes a stockup zone, a feed zone and eddy current inspection equipment with the feed zone. The columnar bodies are fed via guide equipment end to end in an abutting relationship and detection equipment monitors blockages of the columnar bodies and enables dislodgement of the same.

8 Claims, 13 Drawing Sheets

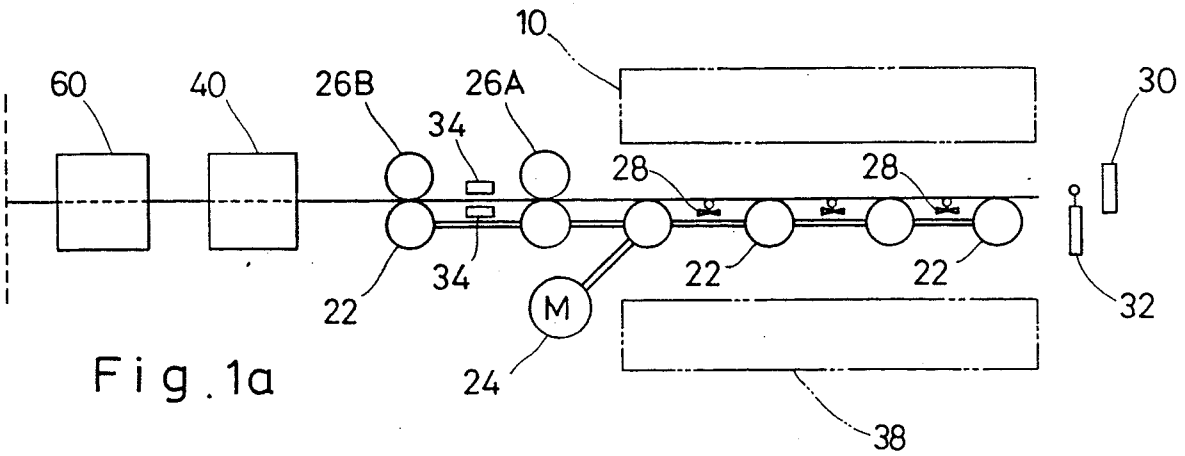
Fig. 1a
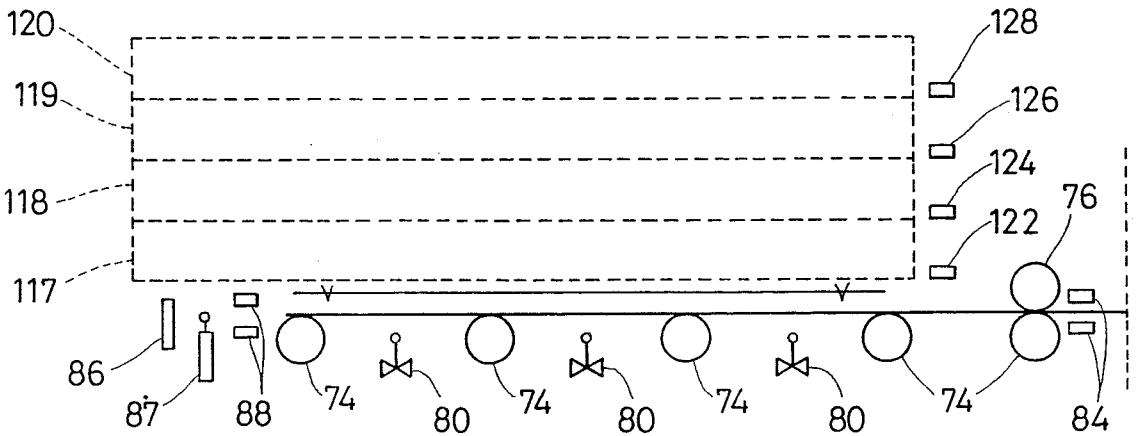
Fig. 1b
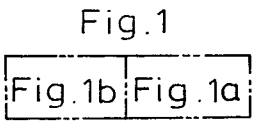

AUTOMATED APPARATUS FOR INSPECTING COLUMNAR BODIES BY EDDY CURRENT METHOD

BACKGROUND OF THE INVENTION

1. Field of the Invention

The present invention relates to an automated apparatus for inspecting columnar bodies by an eddy current method, and more particularly to an apparatus for inspecting columnar bodies with high accuracy by an eddy current method, which apparatus can be independently installed anywhere.

2. Description of Related Art

In large steel mills, all steel tubes or steel bars already finished are inspected to determine if any cracks are present, and, if any cracks are found, to measure the sizes of the cracks, thus controlling the quality of the products. Conventionally, the eddy current inspection equipment is mounted on a certain section of the production line. However, in some circumstances, for example, the space available in the steel mill is limited or the need for inspection of the above products occurs in a downstream factory, and the inspection should be carried out away from the production line. There exists a problem when inspection is being carried out by eddy current method whereby if the columnar bodies to be inspected are made of a ferromagnetic substance, a magnetic field should be imposed on the eddy current inspection equipment to enhance the precision of the inspection results. However, the magnetic field will retard the entrance of the columnar bodies into the eddy current inspection equipment or will catch the rear end portions of the columnar bodies which are leaving the eddy current inspection equipment. To resolve this problem, before feeding the columnar products into inspection equipment, it is necessary to butt adjacent end portions of consecutive columnar products, together as if they were integrally formed. Although the columnar products are disposed in a sequential manner on the production line, there should be a proper design to accommodate the inspection operation outside of the production line. Furthermore, the transportation speed of the columnar products must match the data sampling frequency so as to properly record the locations of the cracks on the columnar products. The quantity of data sampled should be designed to enhance the efficiency of processing signals and to ensure that correct analysis results are obtained. In addition, how to increase Signal to Noise Ratio of signals should be carefully considered.

It should be noted that the term "columnar bodies" indicates metal bars and metal tubes with various cross sectional shapes.

Additionally, sometimes a distorted or bent columnar body will block the passage within the inspection equipment. At this time, the operator must stop the production line to remove the bent columnar body before starting the production line again, an operation which is very inconvenient for the operator.

SUMMARY OF THE INVENTION

It is therefore the object of this invention to provide an automated apparatus for inspecting columnar bodies by an eddy current method, which has a high inspection accuracy and can be independently installed anywhere.

It is another object of this invention to provide an automated apparatus for inspecting columnar bodies by the eddy current method, which can automatically remove bent columnar bodies before carrying out the inspection.

The above objects can be achieved by an automated apparatus for inspecting columnar bodies by the eddy current method, which includes a stockup zone adapted for storing a plurality of columnar bodies; a feed zone disposed near the stockup zone for receiving the columnar bodies fed from the stock zone; eddy current inspection equipment disposed downstream of the feed zone and in alignment with the feed zone; guide equipment disposed between the feed zone and the eddy current inspection equipment for receiving the columnar bodies fed from the feed zone and guiding the columnar bodies to be inspected into the eddy current equipment is a proper manner; a computer coupled to the eddy current inspection equipment for sampling the signals generated by the eddy current inspection equipment for each certain distance transferred along the columnar bodies and processing the signals sampled to estimate the classes of the columnar bodies inspected and subsequentially sending out class signals in accordance with the estimation; a discharge zone disposed downstream of the eddy current inspection equipment for receiving the columnar bodies coming out from the eddy current inspection equipment, which is provided with a push mechanism; a distribution zone disposed near the discharge zone, which is provided with a distribution mechanism and a plurality of storage areas; and a programmable logic controller coupled respectively to the stockup zone, the feed zone, the eddy current inspection equipment, the guide equipment, the computer, the discharge zone and the distribution zone for controlling the feed mechanism to feed the columnar bodies into the feed zone one by one at a proper timing; the logic controller controlling the transfer mechanism to transfer the columnar bodies toward the eddy current inspection equipment and to conduct the leading end portion of a following columnar body to urge the trailing end portion of a columnar body ahead, so as to impel the columnar bodies going through the eddy current inspection equipment to reach the discharge zone; controlling the push mechanism to push the columnar body on the discharge zone onto the distribution mechanism; and responding to the class signals sent from the computer to conduct the distribution mechanism to allocate the columnar body on the distribution mechanism into one of the storage areas.

Other and further objects, features and advantages of this invention will appear more fully in the following description.

BRIEF DESCRIPTION OF THE DRAWINGS

This invention will be explained in more detail on the basis of an exemplary embodiment with reference to the drawings, in which;

FIGS. 1, 1*a* and 1*b* are schematic plan views showing the layout of the apparatus according to this invention;

DETAILED DESCRIPTION OF THE PREFERRED EMBODIMENT

Figure 2:
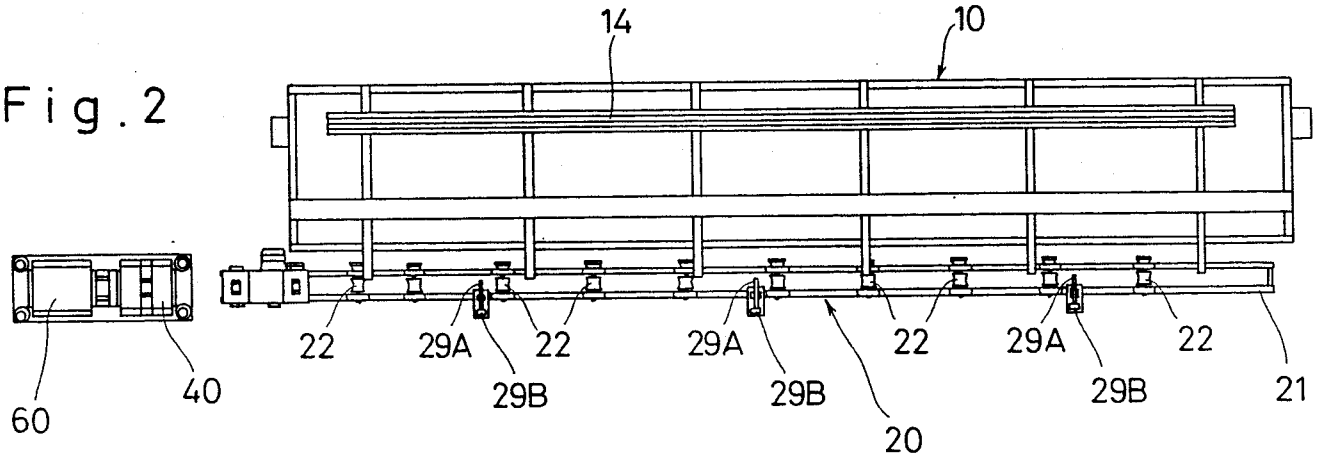
FIG. 2 is a top view showing the stockup zone, the feed zone, the guide zone and the inspection zone of the apparatus according to this invention.
Figure 3:
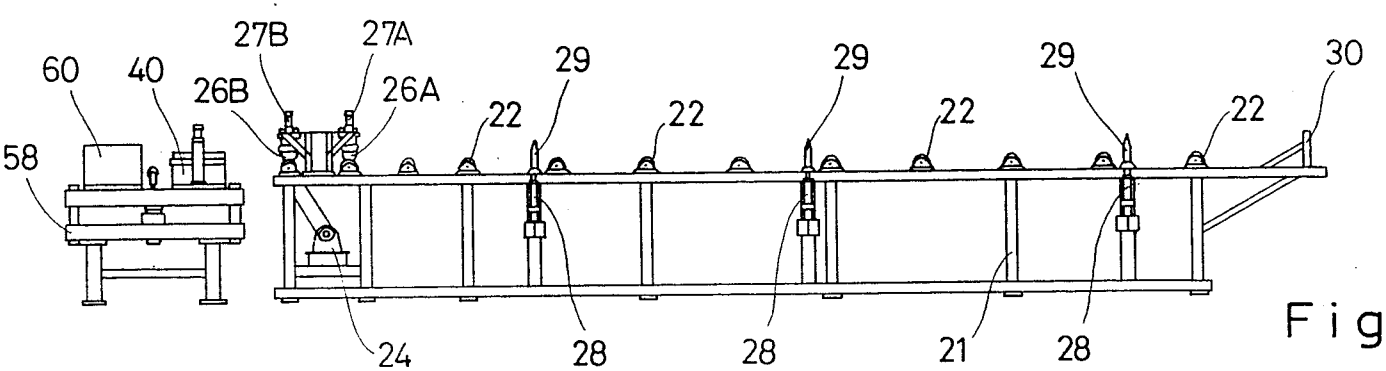
FIG. 3 is a front view of the zones shown in FIG. 2.
Figure 4:
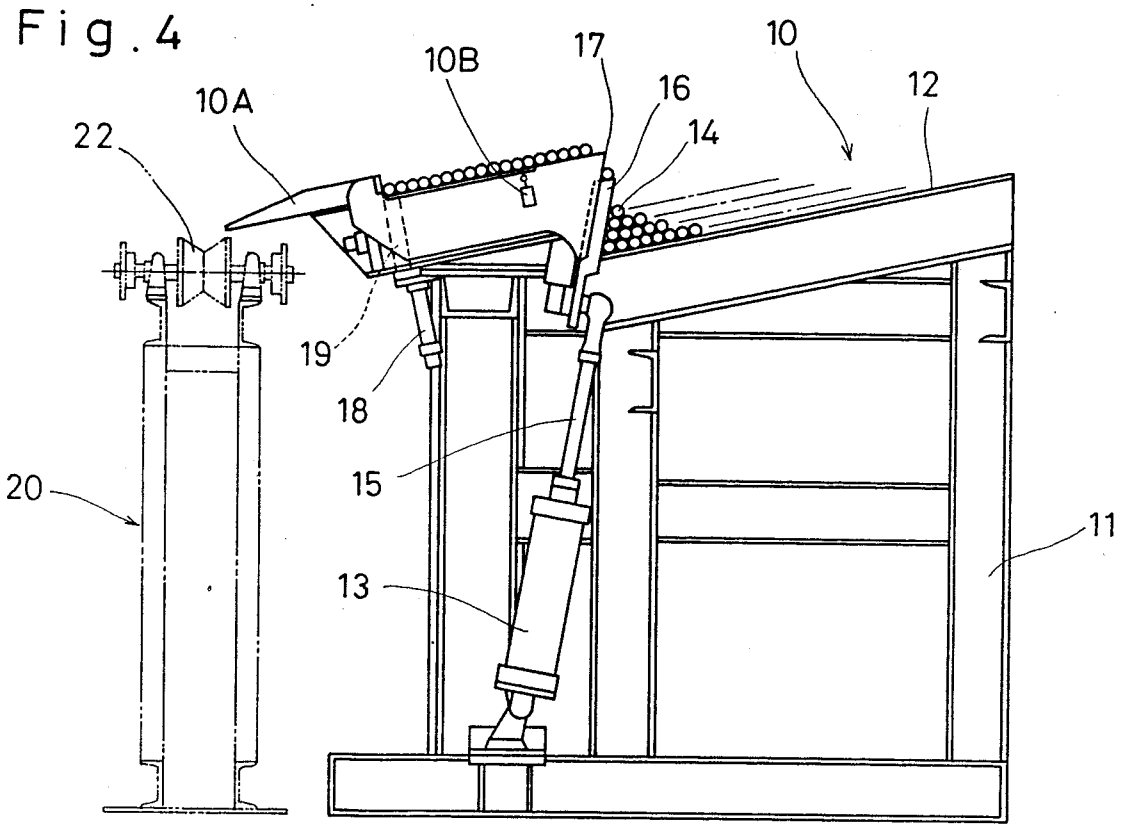
FIG. 4 is a side view showing the feed mechanism of a preferred embodiment of this invention.

As shown in FIG. 1 to FIG. 4, the automated apparatus for inspecting columnar bodies by an eddy current method includes a stockup zone 10 and a feed zone 20, The columnar bodies to be inspected are piled on the stockup zone 10 and will be fed into the feed zone 20 one by one. A preferred embodiment of the stockup zone 10 is disclosed in the U.S. patent application "APPARATUS FOR AUTOMATICALLY FEEDING COLUMNAR BODIES" filed on the same day as this application FIG. 4 is the side view of the feed mechanism disclosed in "APPARATUS FOR AUTOMATICALLY FEEDING COLUMNAR BODIES". As shown in FIG. 4, the mechanism includes a support frame 11. A stockup chute 12 and a feed chute 17 are formed on the support frame. The operator may stow the columnar bodies to be inspected on the stockup chute 12. A plurality of air cylinders or hydraulic cylinders 13 (only one cylinder can be seen in FIG. 4) drive the push rods 15 to push or pull the push blocks 16 to move upward or downward so as to push the columnar bodies 14 one by one onto the feed chute 17, and the columnar bodies 14 pushed up will be disposed on the feed chute 17 in a parallel manner.

Furthermore, a plurality of air cylinders or hydraulic cylinders 18 (only one cylinder can be seen in FIG. 4) drive the push blocks 19 connected thereto to move upward and downward so as to push the columnar bodies one by one onto the inclined guide beams 10*a*, and the columnar body 14 pushed up will then roll down to the rolls 22 of the feed zone 20. A limit switch 10*b* is secured at a proper location of the feed chute 17 to check whether the columnar body 14 piled on the top reaches the limit switch 10*b* or not. If so, the system will stop the motion of the cylinders 13 (as described below), if not, the system will continue driving the cylinders 13 to push the columnar bodies upward. It should be noted that the feed mechanism of stockup zone 10 used in this invention is not necessarily similar to that of the above-mentioned patent application "APPARATUS FOR AUTOMATICALLY FEEDING COLUMNAR BODIES", as any proper mechanism will be acceptable.

As shown in FIG. 3, the feed zone 20 includes a support frame 21, a plurality of rollers 22 mounted on the support frame 21 and a motor 24 for driving the rollers 22 to rotate about their own pivotal axes. Two pinch rollers 26*a* and 26*b* are mounted above two of the rollers 22. The two pinch rollers 26*a* and 26*b* can be driven by two air cylinders 27*a* and 27*b* to move upward and downward. Three air cylinders 28 are mounted on the frame 21, and each rod of the air cylinders 28 are connected to an "L" shaped removal element 29. When an exceedingly distorted columnar body is found, the air cylinders 28 will drive the removal elements 29 to rotate ninety degrees to remove the distorted columnar body. That is, the horizontal portions 29*a* of the removal elements 29 will stand up and pick up the distorted columnar body and then the distorted columnar body will roll down onto a removal zone 38 along inclined portions 29*b* of the removal elements 29 (see FIG. 2). The distorted columnar body removed from the rollers will be collected within a container 38 (or a disposal zone) for subsequent handling. The support frame 21 is also provided with a stopper 30 and a limit switch 32 adjacent to the stopper 30. A pair of photoelectric switches 34 are mounted between the pinch rollers 26*a* and 26*b* for determining if a columnar body is passing thereover. It should be noted that the power for transferring the columnar bodies passing through the inspection equipment 60 is supplied by the rollers 22 and the pinch rollers 26*a*, 26*b*.

Figure 8A:
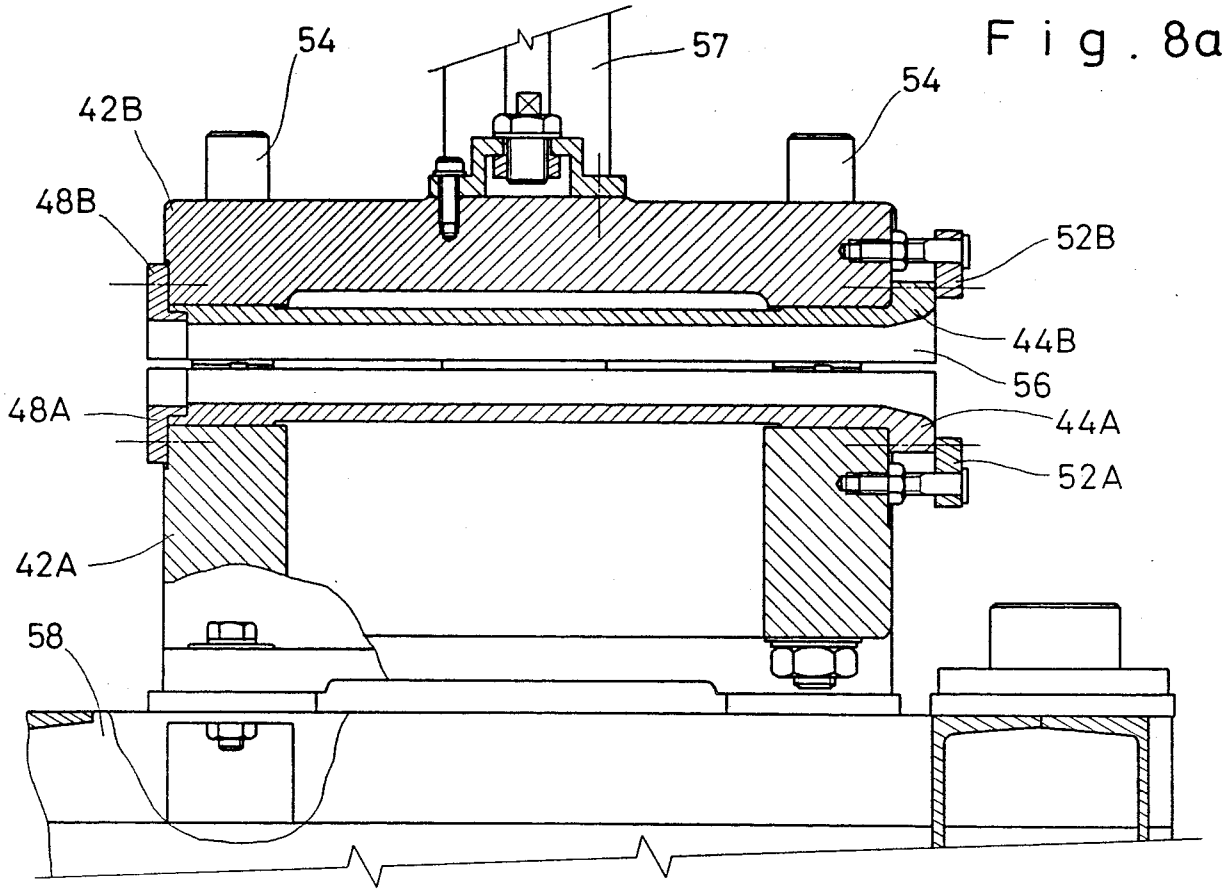
FIG. 8*a* is a sectional view showing the guide equipment of the apparatus according to this invention.
Figure 8B:
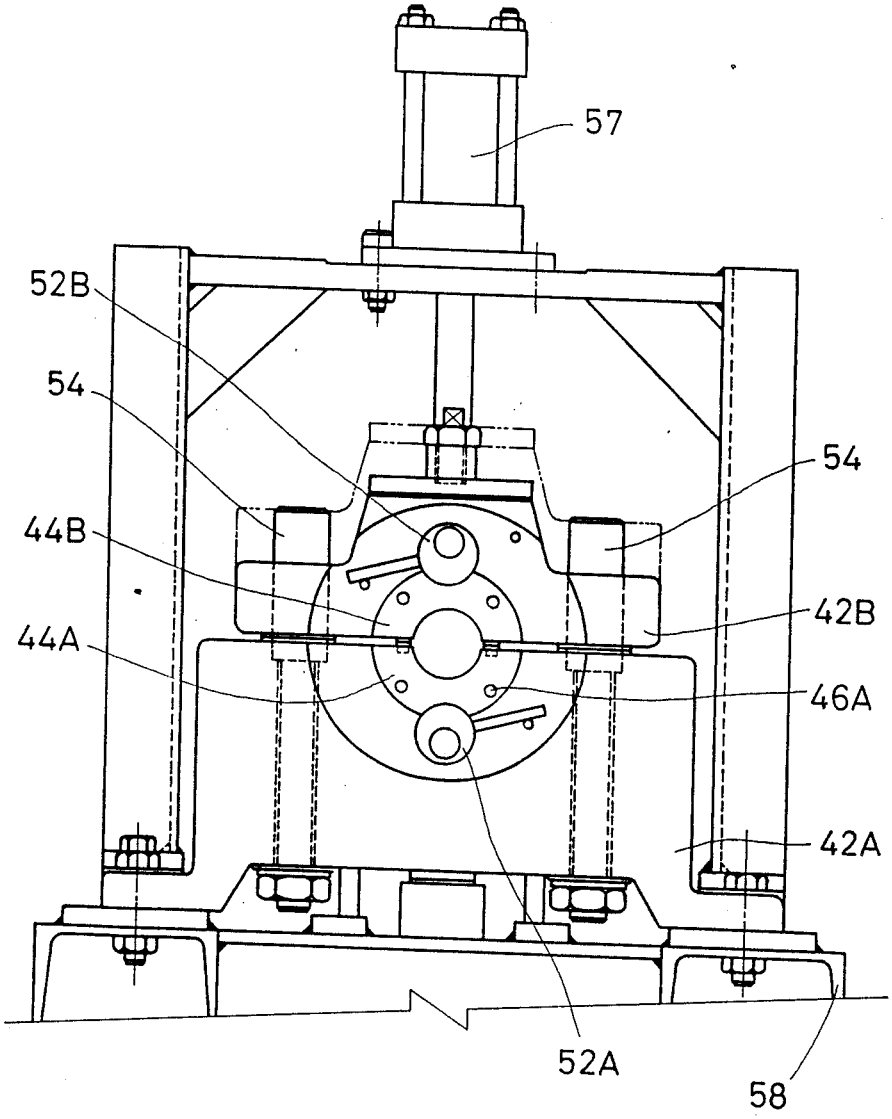
FIG. 8*b* is a side view of the guide equipment shown in FIG. 8*a;*

The inspection equipment according to this invention includes a guide equipment 40 and an eddy current inspection equipment 60 disposed in juxtaposition and secured on a support frame 58. Referring now to FIGS. 8*a* and 8*b*, the guide equipment 40 for guiding the columnar bodies 14 into the eddy current inspection equipment 60 at a correct angle includes a lower block 42*a* secured on the frame 58, a lower sleeve 44*a*, one end portion of which is secured to the lower block 42*a* by two guide pins 46*a*, a lower cover 48*a* secured to the lower block 42*a* by screws, one end portion of which urges the outer end portion of the lower sleeve 44*a* when secured. A lower clamp element 52*a* is secured to the lower block 42*a* by a screw bolt for urging the lower sleeve 44*a* onto the lower block 42*a*. The lower portions of four guide bars 54 are fixed on the lower block 42*a*, and the upper portions thereof are extending upward. An upper block 42*b* is mounted from the top of the guide bars 54 to sleeve around them, and an upper sleeve 44*b*, an upper cover 48*b* and a clamp element 52*b* are secured similar to those of the lower sleeve 44*a*, the lower cover 48*a*, and the clamp element 52*a*. There is a gap between the upper and lower sleeves 44*b* and 44*a* (in other words, the upper and lower covers 48*b* and 48*a*), and a columnar body passage 56 is formed therebetween. As shown in FIG. 8*a*, the diameter of the inlet of the columnar body passage 56 is larger than that of the outlet, so as to let the columnar bodies pass therethrough easily. The inner diameters of the sleeve 44 and the cover 48 can be altered to accommodate the diameter of the columnar bodies. An air cylinder 57 is mounted above the upper block 42*b* for removing the exceedingly distorted columnar body which blocked the passage 56. By lifting up the upper block 42*b* along the guide bars 54 together with the upper sleeve 44*b* and the upper cover 48*b*, the exceedingly distorted columnar body can be easily removed (as described below).

Figure 11:
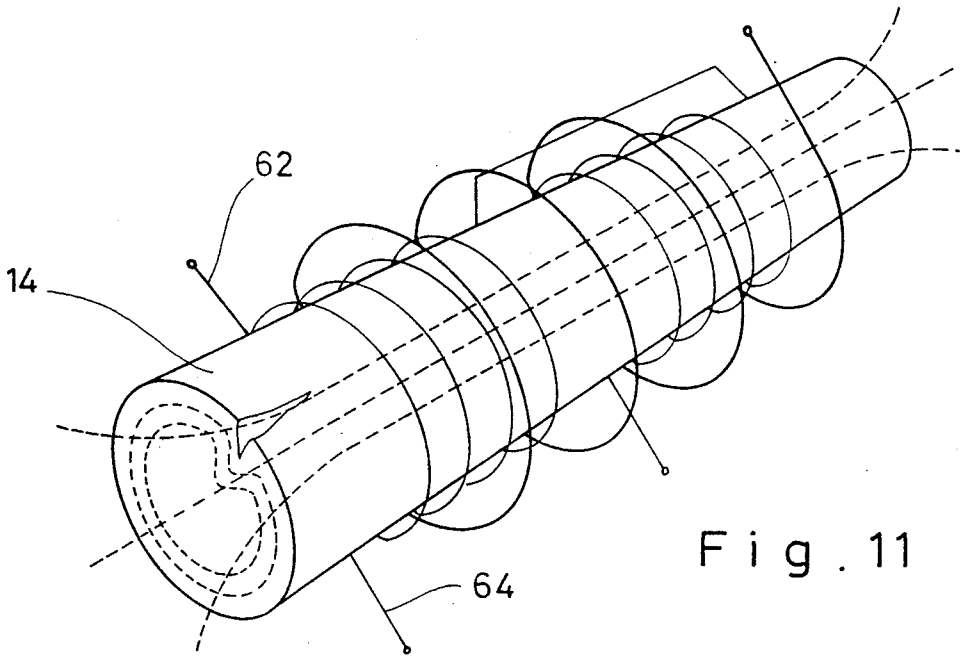
FIG. 11 is a perspective view showing the inspection plug of this invention and a columnar body to be inspected.

One preferred type of eddy current inspection equipment used in this invention is produced by INSTITUT DR FORSTER COMPANY of WEST GERMANY, the module number being DEFECTOMAT F2.825, the plug of which is of a differential type and the winding method of the primary winding 62 and secondary winding 64 is shown in FIG. 11. Referring to FIGS. 1*b*, 5, 6 and 7, the eddy current equipment of this invention is also provided with a discharge zone 70. The discharge zone 70 includes a support frame 72 and a plurality of rollers 74 mounted on the support frame 72. A pinch roller 76 is mounted above the roller located at the right side (see FIGS. 1*b* and 6) and can be driven upward and downward by the air cylinder 78. Three air cylinders 80 are fixed on the support frame 72 whose rods can move along a horizontal line. One pair of photoelectric switches 84 are mounted near the pinch roller 76 and a stopper 86 is fixed on the left side of the frame 72. Furthermore, one pair of photoelectric switches 88 and a limit switch 87 are mounted near the stopper 86. When the photoelectric switches 84 detect the passing of the columnar body, the pinch roller 76 will be pushed down be the air cylinder 78 for pinching the columnar body, so as to prevent vibration or jerking of the columnar body.

Figure 5:
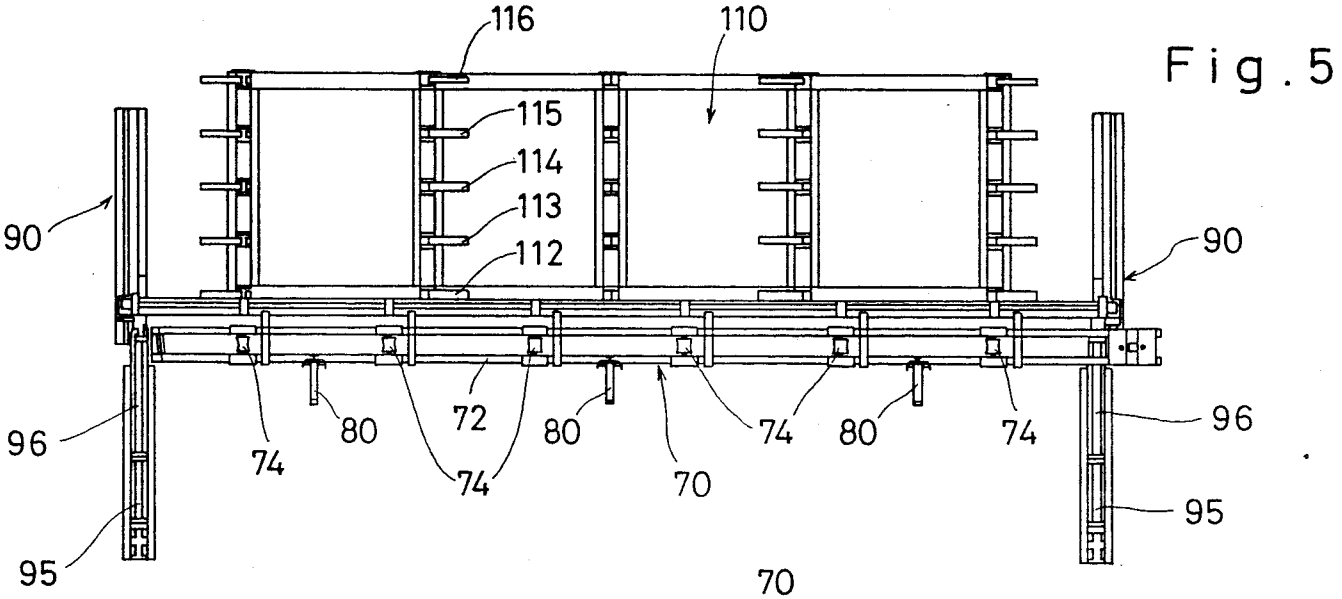
FIG. 5 is a top view showing the discharge zone and the distribution zone of the apparatus according to this invention.
Figure 6:
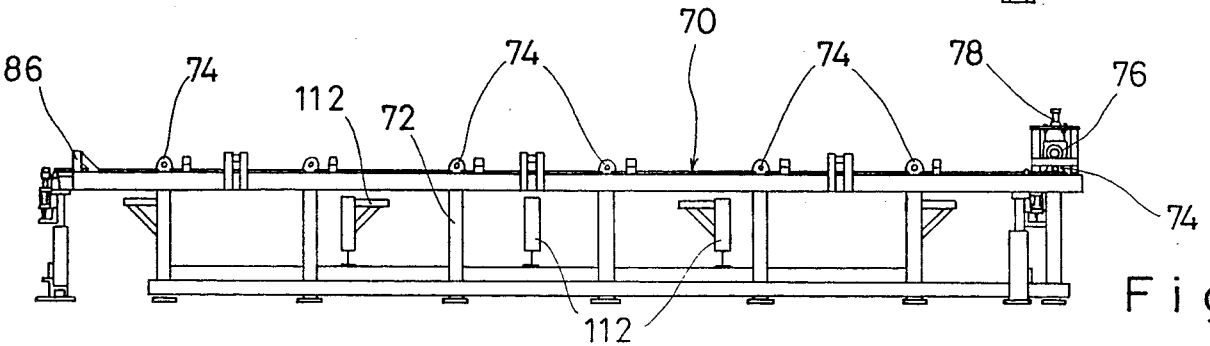
FIG. 6 is a front view of the discharge zone and the distribution zone of the apparatus shown in FIG. 5.
Figure 7:
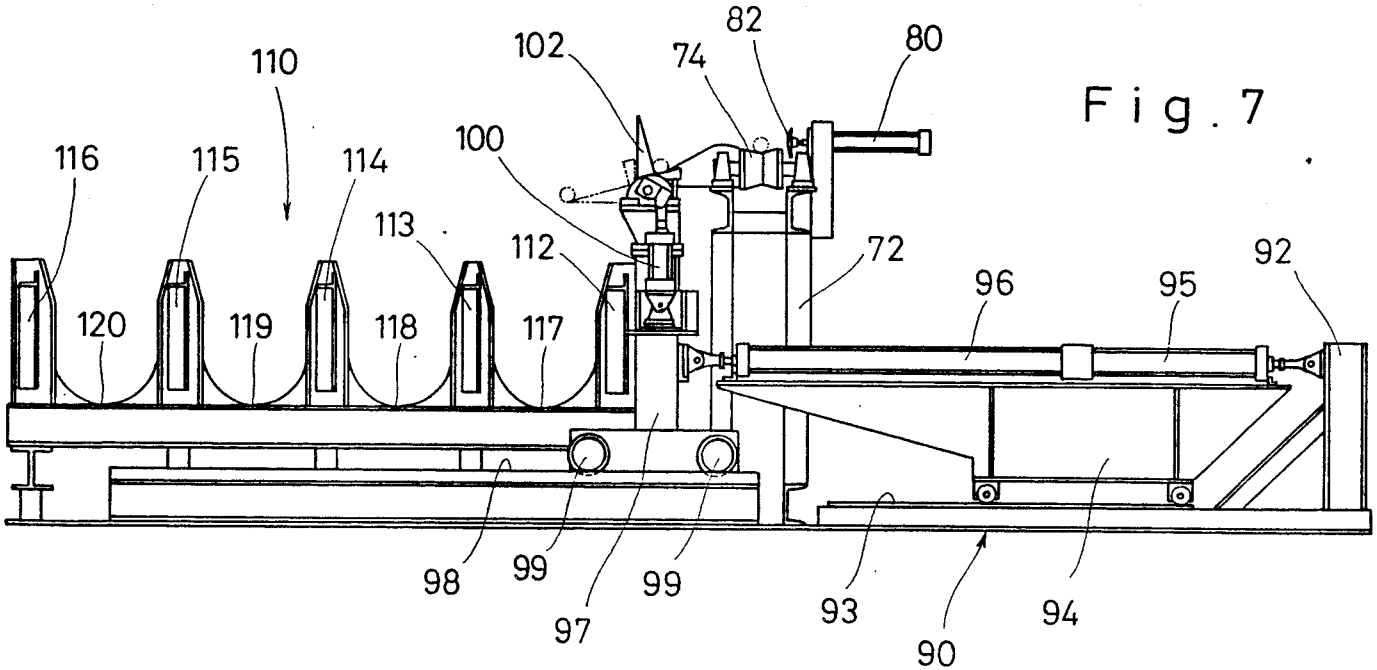
FIG. 7 is an enlarged side view showing the distribution zone of the apparatus according to this invention.

As shown in FIGS. 5 and 7, a distribution mechanism 90 and a distribution area 110 are provided near the discharge zone 70. Two bases 92 of the distribution mechanism 90 are respectively mounted on the two side ends of the discharge zone 70. A first rail 93 is formed on each base 92 and a first carriage 94 is mounted thereon in such a manner that the carriage 94 can move freely on the rail 93. Two cylinders 95 and 96 facing opposite directions are fixed on the top of the carriage 94. The front end portion of the cylinder 95 is fixed on the base 92 and the front end portion of the cylinder 96 is fixed on a second carriage 97 which is mounted on a second rail 98 is such a manner that the carriage 97 can move freely on the rail 98. An air cylinder 100 is mounted on the carriage 97, and an "L" shaped distribution element 102 connected to the rod of the air cylinder 100 can be driven to rotate about ninety degrees by the air cylinder 100 (see FIG. 7).

The distribution zone 110 is provided with five frames 112, 113, 114, 115 and 116 which partition the distribution zone 110 into four distribution areas 117, 118, 110 and 120. It should be noted that the number of distribution areas may be increased or decreased if necessary. Furthermore, four proximity switches 122, 124, 126 and 128 are provided in the frames 112, 113, 114 and 115 respectively (see FIG. 1*b*).

Figure 9A:
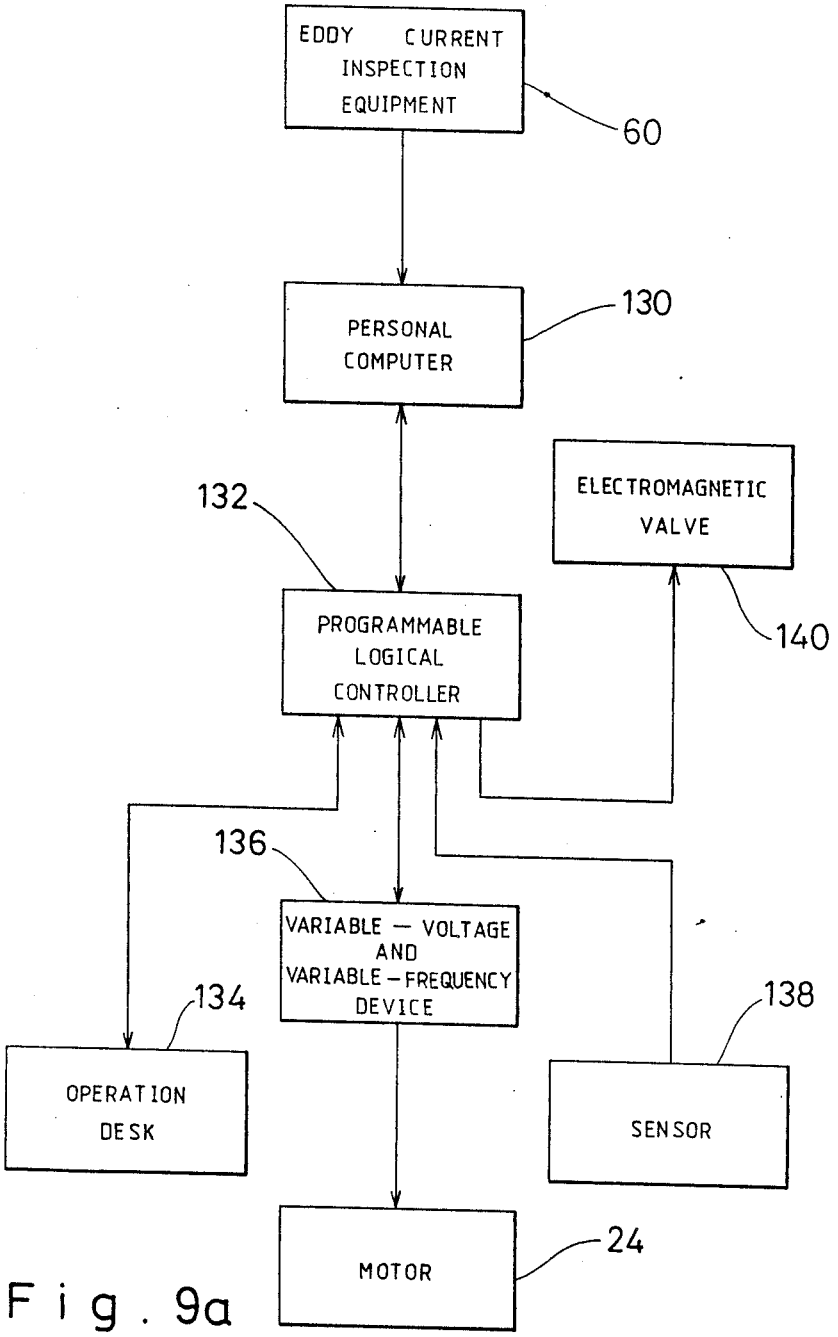
FIG. 9*a* is a diagram showing the connection between the eddy current inspection equipment and other calculation units.

FIG. 9*a* is a diagram showing the connection between the eddy current inspection equipment 60 and other calculation units. As shown in FIG. 9*a*, the eddy current inspection equipment 60 is coupled to a personal computer 130 (for example, an IBM PC), and crack signals picked up by the equipment 60 are input into the computer 130. A programmable logic controller 132 is coupled to the computer 130 for controlling the whole system in accordance with the results calculated by the computer 130. The programmable logic controller 132 is also coupled to an operation desk 134, a variable-voltage and variable-frequency device 139, a plurality of sensors 138 and a plurality of electromagnetic valves 140. The operation desk enables the operator to control the whole system of this invention by means of buttons, and the variable-voltage and variable-frequency device 136 is coupled to a motor 24 for controlling the speed and the directions of rotation of the motor 24. The sensors 138 include all of the limit switches, the proximity switches and the photoelectric switches. The electromagnetic valve 140 is used for controlling the intake and the exhaust of the air cylinder described above.

Figure 9B:
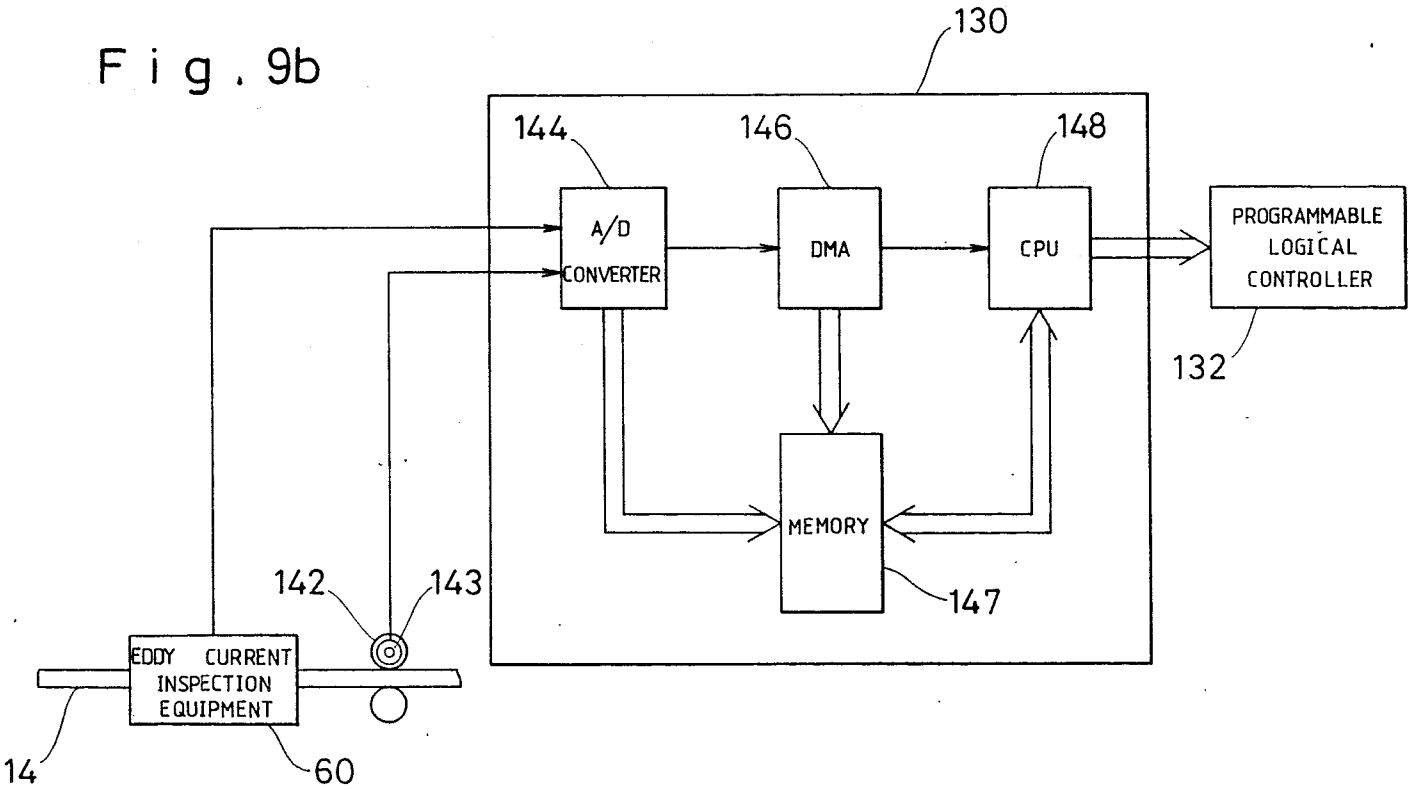
FIG. 9*b* is a block diagram showing the data sampling process of the apparatus of this invention.

FIG. 9*b* shows that the eddy current inspection equipment 60 is coupled to the personal computer 130. As described below, the transferring speed of the columnar bodies 14 is not constant. That is to say, the sampling frequency of the plug of the inspection equipment 60 can not be altered. An encoder 143 is mounted on a roller 142 secured on the passage for the columnar bodies 14, whereby the roller 142 makes frictional contact with the columnar bodies and rotates in accordance with the transferring of the columnar bodies. The encoder 143 is driven to rotate by the roller 142, and the encoder 143 outputs a predetermined numbers of pulses to the A/D converter 144 of the computer 130 during one turn of the roller's rotation. The personal computer 130 responds to the pulses coming from the encoder 143 to sample the crack signals from the eddy current inspection equipment 60. By this, the sampling of crack signals will be synchronized with the generation of the pulses and subsequently the transferring speed of the columnar bodies, and thus the spacial frequency is constant.

As shown in FIG. 9*b*, the personal computer 130 includes an A/D converter 144, a DMA 146, a memory 147 and a CPU 148. The A/D converter 144 samples the crack signals coming from the eddy current inspection equipment 60 and converts them into digital signals, then the digital crack signals are transferred into the memory 147 by the DMA 146 without interrupting the process of the CPU 148. The CPU 148 will fetch the crack signals at the proper time and proceed to judge the number of the cracks, sizes and classes of the cracks, and then it will generate control signals for the programmable logic controller 132 to control the entire system.

Figure 10:
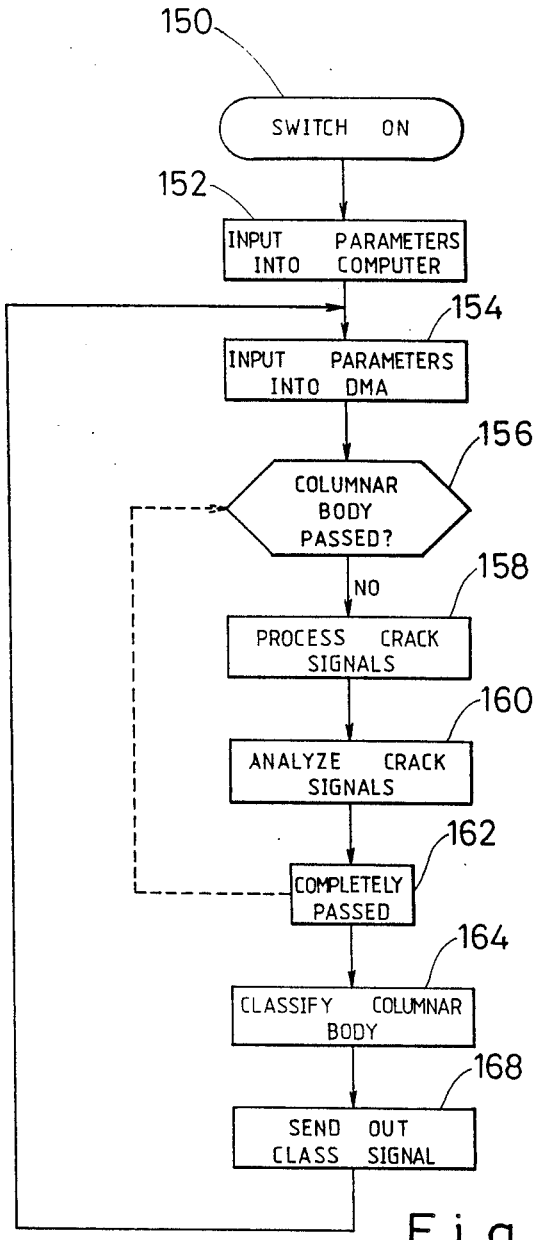
FIG. 10 is a flow chart showing the control process in the personal computer shown in FIG. 9.

The flow chart of the control process of the personal computer 130 is shown in FIG. 10. As shown in FIG. 10, several parameters are input into the computer 130 (step 152) after the switch-on (step 150) of the computer 130, and then several parameters are input into the DMA 146 (step 154). After all of the parameters are input, the computer 130 estimates if the columnar body being processed has passed the eddy current equipment 60 (steps 156 and 162), if not, it fetches the crack signals from the memory 147 to process them (step 158) and analyze them (step 160) until the columnar body completely passes through the eddy current equipment 60. At that time, the computer 130 will classify the columnar body inspected (step 164) and send a class signal to the programmable logic controller 132, and then the process will return to step 154 to inspect the next columnar body.

As described above, the spacial frequency of the crack signals is kept constant by the encoder 143, and the plug of the eddy current inspection equipment is a differential type. If a certain crack appears in the columnar body being inspected, one pair of signals having one positive and the other negative with a predetermined spacial delay, will be picked up by the plug. If a noise is picked up, the signals will not be detected in pairs or in a predetermined spacial relationship. An autocorrelation function is selected for processing the signals sampled by the computer 130 to promote the Signal to Noise Ratio. The autocorrelation function is $$R(\tau) = \lim_{c \to \infty} (1/c) \int_{o}^{c} q(t)q(t+\tau)dt. \quad (1)$$

The above equation can be rewritten in the digital form of $$O(n) = \sum_{k=0}^{m-1} I(n-k)I(n-k-l). \quad (2)$$

wherein

I: signals input;
n: serial number;
l: shift between serial numbers;
m: integration interval; and
O: signals outputted.

If the distance between the secondary coils is G and the length of sampling is T, then set $$l = m = G/2T.$$

The equation (2) can be simplified as follows:

$$\begin{aligned} O(n) &= \sum_{k=0}^{m-1} I(n-k-1)I(n-1-k-l) - \\ &\quad I(n-m)I(n-m-l) + I(n)I(n-l) \\ &= O(n-1) - I(n-m)I(n-m-l) + I(n)I(n-1). \end{aligned}$$

The Signal to Noise Ratio can be promoted by using the above equation. The calculation processes are simplified as two multiplications, one addition and one subtraction (see above equation), and the speed of processing the data is accelerated.

Figure 12A:
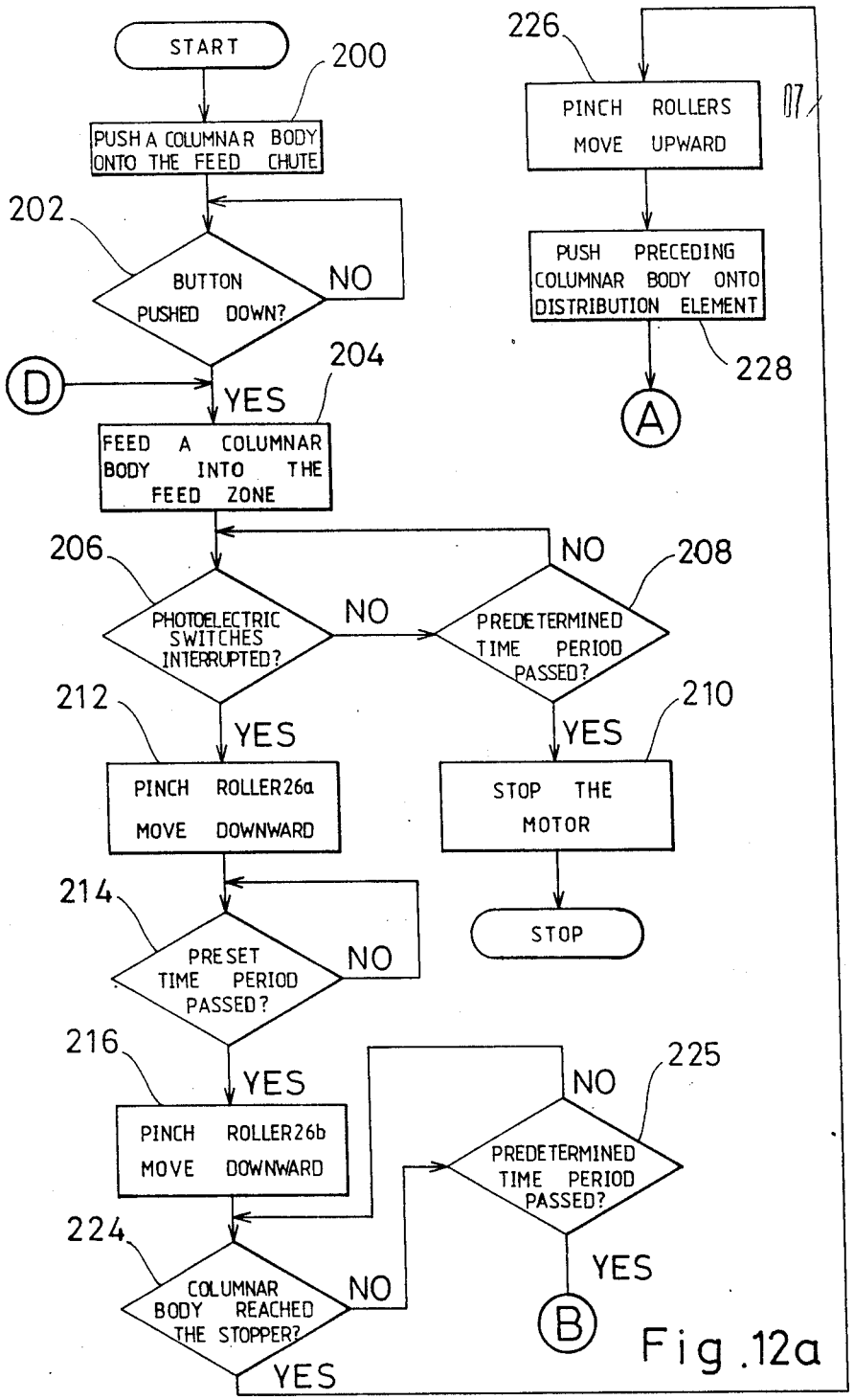
FIGS. 12*a* and 12*b* are flow charts showing the control process of the eddy current inspection equipment of the apparatus according to this invention.
Figure 12B:
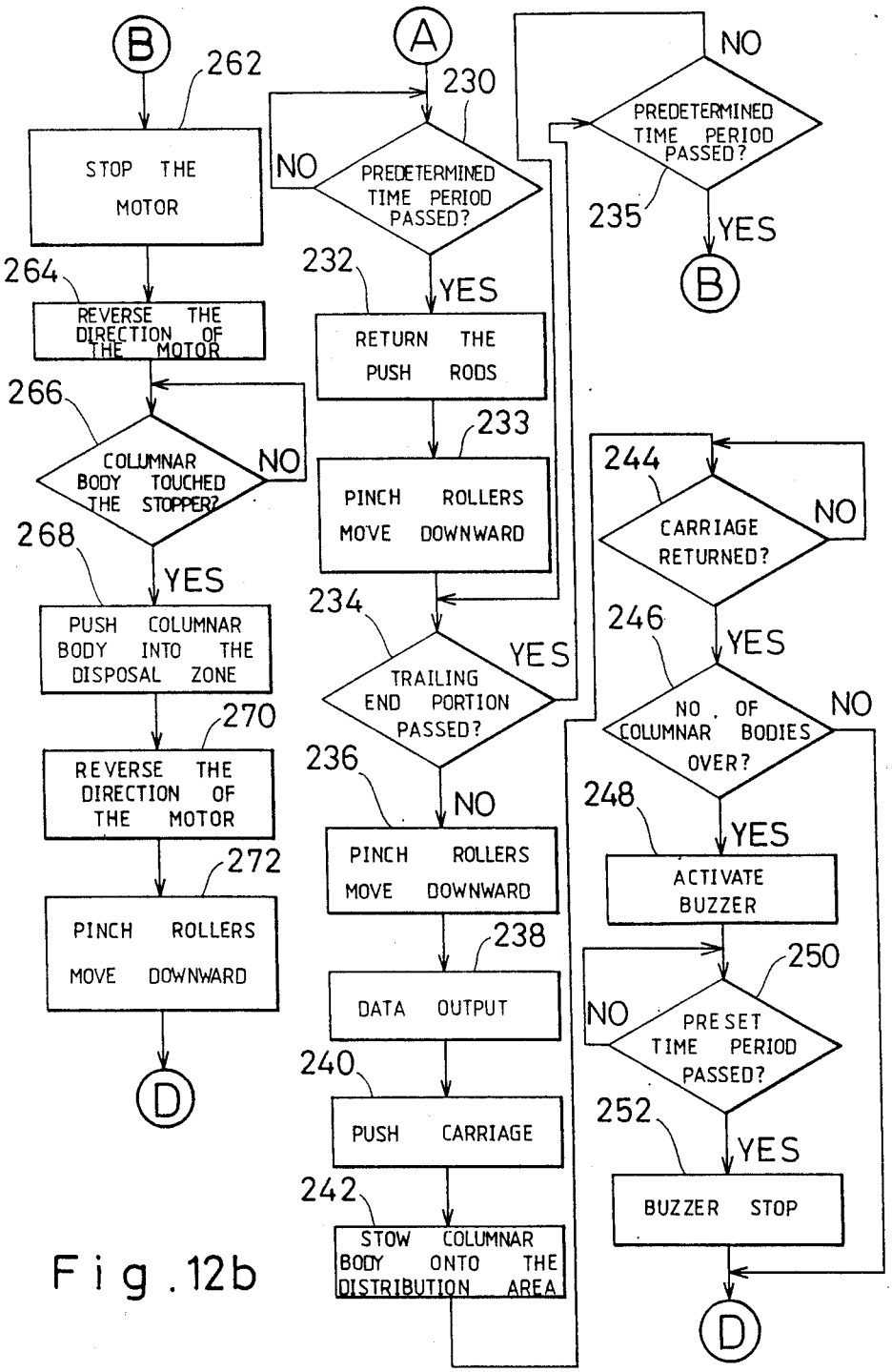

The structures of this invention are described above, and now the operation of this invention will be described with reference to FIGS. 12*a* and 12*b*. The motor 24 will be activated to rotate when the power of the entire system is switched on. At this time, the operator stows the bundle of columnar bodies to be inspected on the stockup chute 12 of the stockup zone 10 and pushes a "stockup pushup start" button. The programmable logic controller 132 will then activate the air cylinders 13 to move the push rods 15 and push blocks 16 upward and downward. The columnar bodies will subsequently be pushed upward onto the feed chute 17 one by one. When the columnar body at the top thereof reaches the limit switch 10*b*, the motion of the air cylinders 13 will be stopped. The motion of the air cylinders 13 will be started anew when the lowest one of the columnar bodies on the feed chute 17 is fed into the feed zone 20, and one of the columnar bodies piled on the stockup chute 12 will be pushed upward onto the feed chute 17 to refill the line of the columnar bodies on the feed chute 17 (block 200). It is to be noted that if the columnar bodies to be inspected are made of a ferromagnetic substance, a magnetic field should be imposed on the eddy current inspection equipment 60 to enhance to precision of the inspection results. However, the magnetic field will retard the entrance of the columnar bodies into the eddy current inspection equipment 60. At this time, the operator may first feed a columnar body or a test piece into the eddy current inspection equipment 60 manually or by means of automatic device, then impose the magnetic field. As described above, the power of transferring the columnar bodies is supplied form the feed zone 20. If the end portion of the test piece of the columnar body leaves the rollers 22 and pinch rollers 26*a* and 26*b*, the test piece will stop moving. If the columnar bodies to be inspected are not made of a ferromagnetic substance, then the above problem will not occur. For the convenience of explaining this invention, it is supposed that a columnar body has been mounted between the eddy current inspection equipment 60 and the guide equipment 40. The programmable logic controller 132 will constantly check if the "first columnar body" button on the operation desk 134 is pushed down (step 202) or not. If the button is not pushed down, the system will be held in a stand-by state, and if the button is pushed down, the air cylinders will be activated to feed a columnar body into the feed zone 20 (step 204).

During the time period of transferring the columnar bodies toward the eddy current inspection equipment 60, the system checks whether the light beam between the photoelectric switches 34 has been interrupted by a columnar body (in determination blocks 206 and 208). If the light beam has not been interrupted over a predetermined time period, then there is no columnar body being sent from the stockup zone 10 to feed zone 20 or else there is a fault in the stockup zone 10, and the motor 24 will be stopped (step 210). Thus, the inspection operation is temporarily stopped until the next activation. If the light beam between the photoelectric switches 34 is interrupted by a columnar body for a predetermined time period, it will mean that the leading end portion of the columnar body has passed over the pinch roller 26*a*. Thus, the pinch roller 26*a* will be driven to urge the columnar body downward by the air cylinder 27*a* (step 212), and the pinch roller 26*b* will also be driven to urge the columnar body downward by air cylinder 27*b* (step 216) after a preset time period (step 214). The pinch rollers 26*a* and 26*b* are mounted for increasing the push force of the columnar body which pushes the preceding columnar body passing through the eddy current inspection equipment 60. By this, the columnar bodies to be inspected will be transferred one by one with each pair of opposite end portions butting together, as if they were an integral bar, and thus the magnetic field imposed on the eddy current inspection equipment 60 will not induce attractive forces or expulsion forces between neighboring columnar bodies. Furthermore, the slits between neighboring columnar bodies is greater than the cracks formed on the columnar bodies, so that the personal computer can distinguish the cracks belonging to each of the neighboring columnar bodies.

Subsequently, the system will determine whether the preceding columnar body has been pushed to reach the stopper 86 of the discharge zone 70 (steps 224 and 225) by means of the photoelectric switches 88 and the limit switch 87. If the preceding columnar body urges the stopper within a predetermined time period, the pinch rollers 26*a* and 26*b* will be driven to move upward to leave the columnar body (step 226). At this time, both of the columnar bodies can not be moved, the upholding of the pinch rollers 26*a* and 26*b* will decrease to a large extent the force needed by the following columnar body to push the preceding columnar body, and thus make it easy to drive the push rods 82 of the air cylinders 80 by the programmable logic controller 132 (see FIG. 7). The push rods 82 of the air cylinders 80 will push the preceding columnar body onto the distribution element 102 to be on standby (step 228), then the push rods 82 of the air cylinders 80 retreat to their original position (steps 230 and 232) after a predetermined time period, and subsequently the pinch rollers 26a and 26b will be driven downward again (step 233) to urge the next columnar body. After this, the system determines whether the trailing end portion of the next columnar body has passed the photoelectric switches 34 after a predetermined time period (steps 234 and 235). If so, it will mean that the trailing end portion of the next columnar body is no longer driven by the rollers 22, the pinch rollers 26a and 26b will be driven to move upward (step 236), and thus the columnar body will stop to wait for the urging by the following columnar body. Afterwards, the computer 130 processes the crack signals of the preceding columnar body, and judges the sizes, the locations and the classes of the cracks, and outputs the above data into the programmable logic controller 132 (step 238). The programmable logic controller 132 drives the air cylinders 95 and/or 96 to push the first carriage 94 and/or the second carriage 97 to reach a position where the columnar body on the distribution element 102 (see FIG. 7) can be fed into the distribution area 117, 118, 119 or 120 (step 240). The system determines the position of the second carriage 97 by means of the proximity switches 122, 124, 126 and 128. When the second carriage 97 reaches its position, the programmable logic controller 132 drives the air cylinder 100 to rotate the distribution element 102 about ninety degrees to stow (or to feed) the columnar body onto the distribution area (step 242). Then, the programmable logic controller 132 determines whether the numbers of the columnar bodies within each distribution area is beyond the present number (step 246) after the carriages 94 and 97 return to their original positions. If not, the process returns to the block 204, and the next columnar body will be fed into the feed zone 20. If so, the programmable logic controller 132 activates a buzzer (not shown) to generate a warning sound (step 248). At this time, the operator may remove the columnar bodies inspected. After a present time period (step 250), the buzzer will stop (step 252) and the process will return to block 204 to inspect the next columnar body.

If a columnar body did not urge the stopper 86 within a predetermined time period (in determination blocks 224 and 225), the columnar body may be blocked somewhere. Similarly, if the columnar body did not leave the rollers 22 (that is, the light beam between photoelectric switches 34 is still interrupted) within a predetermined time period (in determination blocks 234 and 235), the columnar body may also be blocked somewhere, and the process will proceed to step 262. At this time, the air cylinder 57 will be activated to open the guide equipment 40, and the motor 24 will be driven to rotate in the reverse direction (step 264) to move the columnar body being blocked backward, and then the system determines if the columnar body is touching the stopper 30 by means of the limit switch 32 (step 266). If so, the programmable logic controller 132 drives the air cylinders 28 to push the columnar body into the disposal zone 38 (step 268). Afterwards, the motor 24 is activated to rotate in the positive direction (step 270) and the pinch rollers 26a and 26b will be driven to move upward. Then, the process will revert back to the block 204 to inspect the next columnar body. The operator should turn off the magnetic field imposed on the eddy current equipment 60 before feeding a columnar body into the eddy current equipment 60.

Although the invention has been described in its preferred form with a certain degree of particularity, it is understood that the present disclosure of the preferred form may be somewhat changed, construction in combination and arrangement of parts without departing from the spirit and the scope of the invention as hereinafter claimed.

What is claimed is:

1. An automated apparatus for inspecting columnar bodies by an eddy current method, comprising:

a stockup zone for storing a plurality of columnar bodies, said stockup zone being provided with feed means for feeding out each of the plurality of columnar bodies one by one;

a feed zone disposed near said stockup zone for receiving the columnar bodies fed from said stockup zone, said feed zone being provided with transfer means for transferring the columnar bodies;

eddy current inspection means disposed downstream of said feed zone and in alignment with said feed zone;

guide means disposed between said feed zone and said eddy current inspection means for receiving the columnar bodies fed from said feed zone and guiding the columnar bodies to be inspected into said eddy current means in a proper manner;

computer means coupled to said eddy current inspection means for sampling the signals generated by said eddy current inspection means for each predetermined distance travelled by the columnar bodies and processing the signals sampled to estimate the classes of the columnar bodies inspected and subsequently sending out class signals in accordance with the estimate of the classes;

a discharge zone disposed downstream of said eddy current inspection means for the columnar bodies coming out from said eddy current inspection means, said discharge zone being provided with push means for discharging said columnar bodies from said discharge zone;

a distribution zone disposed near said discharge zone, said distribution zone being provided with distribution means and a plurality of storage areas; and control means respectively coupled to said stockup zone, said feed zone, said eddy current inspection means, said guide means, said computer means, said discharge zone and said distribution zone for controlling said feed means to feed each of the plurality of columnar bodies into said feed zone one by one at a proper timing;

said control means further controlling said transfer means to transfer the columnar bodies toward said eddy current inspection means and to conduct the leading end portion of a following columnar body to urge the trailing end portion of a leading columnar body so as to impel the columnar bodies though said eddy current inspection means to reach said discharge zone, controlling said push means to push the columnar body in said discharge zone onto said distribution means, responding to the class signals sent from said computer means to enable said distribution means to allocate the columnar body on said distribution means into one of said storage areas;

said distribution means including a carriage and a first actuation means coupled to said carriage and to said control means and enabled by said control means to move said carriage among the storage areas.

2. An automated apparatus for inspecting columnar bodies as claimed in claim 1, wherein subsequent to impelling the columnar body outside of said feed zone, the columnar body will halt due to lack of motivation by said transfer means and, upon detecting that the columnar body is outside of said feed zone, said control means will conduct the next columnar body into said feed zone to urge the trailing end portion of the leading columnar body thereby impelling the columnar body through said guide means as well as said eddy current inspection means for entry into said discharge zone.

3. An automated apparatus for inspecting columnar bodies as claimed in claim 1, wherein said guide means includes lower block means and upper block means movably mounted on said lower block means, and a columnar body passage having an inlet and an outlet formed therebetween, the diameter of said inlet being larger than that of said outlet.

4. An automated apparatus for inspecting columnar bodies as claimed in claim 3, wherein said guide means further includes activation means secured to said upper block means and coupled to said control means, wherein when a columnar body fails to pass through said eddy current means within a present time period, said control means will enable said activation means to lift said upper block means up from said lower block means.

5. An automated apparatus for inspecting columnar bodies as claimed in claim 4, wherein said feed zone further includes removal means coupled to said control means, wherein after said upper block means is lifted up from said lower block means, said control means enables said transfer means to transfer the columnar body away from said guide means and said eddy current inspection means and enables said removal means to remove said columnar body from said feed zone after transferring said columnar body to a predetermined location by said transfer means.

6. An automated apparatus for inspecting columnar bodies as claimed in claim 1, wherein said feed zone further includes two pinch rollers for urging columnar bodies to thereby increase the transferring force of said transfer means.

7. An automated apparatus for inspecting columnar bodies as claimed in claim 1, wherein said carriage is provided with an "L" shaped distribution element pivotally mounted on said carriage for receiving the columnar bodies pushed by said push means and a second actuation means coupled to said distribution element and enabled by said control means to activate said distribution element to rotate thereby allocating the columnar bodies into said storage areas.

8. An automated apparatus for inspecting columnar bodies by an eddy current method, the apparatus comprising:

a stockup zone for storing a plurality of columnar bodies, said stockup zone being provided with feed means for feeding out each of the plurality of columnar bodies one by one;

a feed zone disposed near said stockup zone for receiving the columnar bodies fed from said stockup zone, said feeding zone being provided with transfer means for transferring the columnar bodies;

eddy current inspection means disposed downstream of said feed zone and in alignment with said feed zone;

guide means disposed between said feed zone and said eddy current inspection means for receiving the columnar bodies fed from said feed zone and guiding the columnar bodies to be inspected into said eddy current inspection means in a proper manner;

computer means coupled to said eddy current inspection means for sampling the signals generated by said eddy current inspection means for each predetermined distance travelled by the columnar bodies and processing the signals sampled to estimate the classes of the columnar bodies inspected and subsequently sending out class signals in accordance with the estimate of the classes;

a discharge zone disposed downstream of said eddy current inspection means for receiving the columnar bodies coming out from said eddy current inspection means, said discharge zone being provided with push means for discharging said columnar bodies from said discharge zone;

a distribution zone disposed near said discharge zone, said distribution zone being provided with distribution means and a plurality of storage areas; and control means respectively coupled to said stockup zone, said feed zone, said eddy current inspection means, said guide means, said computer means, said discharge zone and said distribution zone for controlling said feed means to feed each of said plurality of columnar bodies into said feed zone one by one at a proper timing;

said control means further controlling said transfer means to transfer the columnar bodies toward said eddy current inspection means and to conduct the leading end portion of the following columnar body to urge the trailing end portion of a leading columnar body so as to impel the columnar bodies through said eddy current inspection means to reach said discharge zone, controlling said push means to push the columnar body in said discharge zone onto said distribution means, and responding to the class signals sent from said computer means to enable said distribution means to allocate the columnar body on said distribution means into one of said storage areas;

wherein said eddy current inspection means includes a plug of a differential type, and said computer means promotes the Signal to Noise Ratio by means of the autocorrelation function $$O(n)=O(n-l)-I(n-m)I(n-m-l)+I(n)I(n-l)$$

wherein,

I: signals inputted, n: serial number, l: shift between serial numbers, m: integration interval, O: signals outputted, if the distance between secondary coils of said plug is G and the length of sampling is T, then $l=m=G/2T$.

* * * * *